United States Patent [19]

Condas et al.

[11] 4,400,246

[45] Aug. 23, 1983

[54] PROCESS FOR APPLYING BARRIER LAYER ANODIC COATINGS

[75] Inventors: George A. Condas, Castro Valley; Saad K. Doss, Gilroy, both of Calif.

[73] Assignee: International Business Machines Corporation, Armonk, N.Y.

[21] Appl. No.: 392,840

[22] Filed: Jun. 28, 1982

[51] Int. Cl.[3] ..... C25D 11/04

[52] U.S. Cl. ..... 204/58

[58] Field of Search ..... 204/58, 38 A

[56] References Cited

U.S. PATENT DOCUMENTS 2,408,910 10/1946 Burnham ..... 204/58

*Primary Examiner*—R. L. Andrews

*Attorney, Agent, or Firm*—Walter J. Madden, Jr.

[57] ABSTRACT

A barrier anodizing process for an aluminum alloy substrate employs an anodizing current having a density between 20 and 300 milliamps/cm$^2$ to produce a 300 volt barrier layer in respectively 60 and 4 seconds.

4 Claims, No Drawings

PROCESS FOR APPLYING BARRIER LAYER ANODIC COATINGS

BACKGROUND OF INVENTION

1. Field of the Invention

This invention relates to processes for producing barrier anodized layers on aluminum alloy substrates.

2. Description of the Prior Art

The use of barrier anodic coatings for capacitors is well known. Barrier anodization generally refers to anodic coatings that are essentially pore-free and are generally of the order of about $10^{-7}$ meters in thickness, whereas conventional anodic coatings are about $10^{-5}$ meters in thickness. Most of the prior art in barrier anodizing has dealt with high purity aluminum, and not much is known about barrier anodizing of either aluminum alloys or large areas of pure aluminum with pore-free anodized films.

Known barrier anodizing electrolytes for aluminum such as (a) aqueous boric acid-borax solutions, (b) aqueous or semi-aqueous solutions containing citrate or tartrate ions, and (c) solutions of ammonium pentaborate decahydrate in ethylene glycol may be suitable for high purity aluminum, and are generally used for barrier anodizing of aluminum. Aluminum alloys referred to herein are designated by the four digit designation system established by the Aluminum Association and generally known in the art.

U.S. Pat. No. 3,864,219 discloses a barrier anodizing process for aluminum and aluminum alloys in which the anodizing current is maintained at a level between 0.1 and 10 milliamps/cm$^2$.

U.S. Pat. No. 3,846,261 discloses a barrier anodizing proces using alternating electrical current, but no mention is made of the current densities employed.

Summary of the Invention

In accordance with the present invention, barrier anodizing of an aluminum alloy is performed using barrier anodizing current densities which are at least an order of magnitude higher than those employed in the prior art, these high current densities being employed for a shorter length of time than the lower current densities of the prior art. It has been found that barrier anodized layers produced by the present technique have exceptional sealing and adhesion characteristics. These are particularly important, for example, in the treatment of aluminum alloy substrates for use in magnetic recording disks where it is critical that the metal substrate be sealed to prevent corrosion and that this sealing layer have good adhesion to the underlying substrate. Barrier anodized substrates made by the process of the present invention result in good adhesion between the barrier layer and an overlying magnetic layer, such as epoxy/-phenolic/magnetic pigment mixtures.

DESCRIPTION OF THE PREFERRED EMBODIMENT

Barrier anodizing is carried out in a slightly acidic to neutral ($5 \leqq pH \leqq 7$) bath having a DC power supply connected between a cathode and an anode on which the barrier layer is to be formed. In the preferred form of the present invention, the anode is a disk substrate composed of an aluminum alloy such as the type 5086 alloy of aluminum and magnesium, and the barrier layer is a layer of alumina formed on the substrate surface. The phenomenon of barrier anodizing can be represented graphically by a curve plotting anodizing current versus time, with the initial current remaining at a relatively steady level until a time $t_1$, called the barrier formation time, at which time the current begins to decrease as a result of the increased resistance of the essentially non-conductive barrier layer. The current is a function of the current density and the substrate surface area, and the initial current density can be identified as $J_1$. At barrier formation time $t_1$, a barrier of thickness $d_1$ is formed that is related to the upper voltage $V_1$ of the applied power by the equation $$d_1 = V_1 K$$

where K is the growth constant common to aluminum of approximately 14 Å/volt.

It has been discovered by use of an ionic drift model that $$t_1 = BV_1/J_1$$

where B is a constant related to K.

It has been observed that the quality of the barrier film formed is improved with shorter barrier formation times $t_1$, and in accordance with the present invention the anodizing current density $J_1$ is maintained much higher than in the prior art while consequently, the barrier formation time $t_1$ is much shorter than the prior art, resulting in greatly improved barrier films. The current density in the present invention is maintained in the range from 20–300 milliamps/cm$^2$.

One example of the process of the present invention is as follows.

A bath was prepared using 3% by weight of tartaric acid in deionized water. The pH of the bath was adjusted to approximately 7 by the addition of ammonium hydroxide. This solution was in a tank having a stainless steel cathode, with a 14 inch aluminum disk substrate forming part of the anode. An adjustable DC power supply applied 300 volts between the cathode and anode at a current of 30 amperes, resulting in a current density of 300 milliamperes/cm$^2$. This current density was maintained constant until barrier formation time $t_1$, which occurred after 4 seconds. In contrast, with an anodizing current density of 3 milliamps/cm$^2$, this barrier formation time was 400 seconds.

Further, examination of the barrier anodized surface of the present invention visually and by means of a scanning electron microscope (SEM) revealed a virtually defect-free surface. In contrast to this, comparative samples produced at a barrier anodizing current density of 3 milliamps/cm$^2$ and at the same voltage revealed a significant number of defects and voids in the anodized surface.

Hardness tests conducted on the anodized layers produced in accordance with the present invention showed a surface having a Knopp hardness of 480 kG/cm$^2$ with a 5 gram load, which is harder than sealed layers produced on some current 5086 disk substrates by other methods.

To test the suitability of the disk substrates produced by the present process as a base for the application of a liquid magnetic coating, the following adhesion tests were conducted.

Ten 5086 substrates were barrier anodized at each of the following voltages: 50, 100, 150, 200 and 250 V, two disks per voltage setting. The corresponding alumina thicknesses were 700, 1400, 2100, 2800 and 3500 Å respectively. The current density for the anodizing was 20 milliamps/cm$^2$. All parts were then coated with a magnetic coating, cure baked, buffed to about a 41 microinch surface finish, and washed.

The adhesion test for some current magnetic disks requires severe buffing, until the substrate inner diameter (ID) is exposed. The remaining magnetic layer (paint) is then microscopically (X50–200) examined for tears. Acceptable adhesion requires no visible tears. A disk for each barrier forming voltage (five disks) described above was buffed for adhesion testing. The disks whose barriers were processed at 50 and 100 volts had a few small tears. Disks processed at 150 and higher voltages had much better (and acceptable) adhesion. They had no tears whatsoever. An obvious conclusion was that adhesion increases with forming voltage, and acceptable adhesion occurs at barrier voltages of 150 and greater. Very high voltages (greater than 250 V) increase barrier surface roughness; hence, forming voltages in the range of 150–200 are recommended, although voltages up to 500 volts may be employed.

We claim:

1. A method of providing a barrier layer on the surface of an aluminum substrate comprising the steps of barrier anodizing said substrate at an anodizing current density of at least 20 milliamperes/cm$^2$ for a very short period of time not to appreciably exceed the barrier formation time, said barrier anodizing being conducted in an acidic bath having a pH of between 5 and 7.

2. A method in accordance with claim 1 in which said barrier anodizing current is maintained between 20 and 300 milliamperes/cm$^2$.

3. A method in accordance with claim 1 in which the voltage in said barrier anodizing is maintained between 150 and 500 volts.

4. A method in accordance with claim 2 in which said barrier anodizing period of time is between 60 seconds and 4 seconds.

* * * * *